United States Patent [19]

Cooke

[11] 4,162,227

[45] Jul. 24, 1979

[54] DIELECTRIC GAS MIXTURES CONTAINING SULFUR HEXAFLUORIDE

[75] Inventor: Chathan M. Cooke, Cambridge, Mass.

[73] Assignee: The United States of America as represented by the United States Department of Energy, Washington, D.C.

[21] Appl. No.: 660,887

[22] Filed: Feb. 24, 1976

[51] Int. Cl.[2] ..... H01B 3/56

[52] U.S. Cl. ..... 252/63.5; 252/63

[58] Field of Search ..... 252/66, 63, 63.5, 63.7, 252/372; 174/17 GF

[56] References Cited

U.S. PATENT DOCUMENTS

| | | | |
|---|---|---|---|
| 2,221,670 | 11/1940 | Cooper | 252/66 X |
| 2,989,577 | 6/1961 | Berg | 252/66 X |
| 3,154,592 | 10/1964 | Hauptschein et al. | 252/66 X |
| 3,281,521 | 10/1966 | Wilson | 252/66 X |
| 3,390,091 | 6/1968 | Eibeck | 252/63.5 |
| 3,506,774 | 4/1970 | Gard et al. | 252/63.7 X |
| 3,650,955 | 3/1972 | Manion et al. | 252/66 |
| 4,071,461 | 1/1978 | Mears et al. | 252/66 X |

*Primary Examiner*—Harris A. Pitlick

*Attorney, Agent, or Firm*—Dean E. Carlson; Jack Q. Lever

[57] ABSTRACT

Electrically insulating gaseous media of unexpectedly high dielectric strength comprised of mixtures of two or more dielectric gases are disclosed wherein the dielectric strength of at least one gas in each mixture increases at less than a linear rate with increasing pressure and the mixture gases are present in such proportions that the sum of their electrical discharge voltages at their respective partial pressures exceeds the electrical discharge voltage of each individual gas at the same temperature and pressure as that of the mixture.

1 Claim, 3 Drawing Figures

DIELECTRIC GAS MIXTURES CONTAINING SULFUR HEXAFLUORIDE

BACKGROUND OF THE INVENTION

1. Field of the Invention

This invention relates to gaseous dielectric materials and to their use as insulators for electrical apparatus. More particularly, it relates to insulating media comprised of dielectric gas mixtures possessing unexpectedly high strength and to methods of calculating the proportions of such gas mixtures.

2. Description of the Prior Art

In many types of electrical apparatus electrical insulation is achieved by separating the conductors and utilizing atmospheric air as an insulator between them. But these measures may not be adequate for devices with large voltage gradients. Where electrical discharge does become a problem, insulation performance may be improved by using a gas whose dielectric strength is greater than that of air. Such performance may also be improved by increasing the density of the insulating gas, either by increasing its pressure or by lowering its temperature.

While increasing by pressure of a gas almost always increases its dielectric strength, use of this technique may also result in the need for a stronger vessel to contain the gas. Furthermore, pressurization can only be continued until the gas reaches its boiling point since any additional increase in pressure will cause the gas to liquify.

It is therefore desirable to utilize an insulating gas with a low boiling point since it can be more highly pressurized. Unfortunately, gases having the better dielectric strengths also tend to have high boiling points in comparison to gases of poorer strength. Indeed, at the operating temperature for a number of the electrical devices requiring insulation, many of the best dielectrics would be in a liquid state if employed individually.

Another consideration is cost. The better gaseous dielectrics tend to be the most expensive ones. This price differential becomes quite significant in such devices as transmission lines where the expenditure on gas represents a large percentage of the line's cost.

In order to provide a gaseous insulator of sufficient strength which will not liquify and satisfies budgetary constraints, a mixture of gases has often been employed. Thus, a high strength dielectric gas may be mixed with a poorer one of lower cost and/or lower boiling point to provide a mixture with a dielectric strength reported to be somewhere between the strength values for each of the two mixture components.

For example, in "*Insulation Properties of Compressed Electronegative Gases*" by P. R. Howard, Proceedings of IEE, 104A (1957), mixtures of the poor dielectric nitrogen, $N_2$, and the higher strength sulfur hexafluoride, $SF_6$, or dichlorodifluoromethane, $CCl_2F_2$, were shown to have a dielectric strength somewhat above the mean of the strengths of the two components, each component being measured at the same temperature and pressure as that of the mixture. This was also the case in U.S. Pat. No. 2,221,670 where $N_2$ and $CCl_2F_2$ were mixed together. Of course, the insulating mixture may be comprised of more than two gases. In U.S. Pat. No. 3,281,521 a mixture comprised of $N_2$, $CCl_2F_2$ and $SF_6$ exhibited a dielectric strength equal to that of $SF_6$ at the same temperature and pressure. This was less than the strength of $CCl_2F_2$, the best dielectric in the mixture.

This decrease in dielectric strength is an undesirable feature of gas mixtures employed as insulators. But because it has been believed that the dielectric strength of a mixture is always somewhere between the individual strengths of its components at the same temperature and pressure, decreased strength appeared to be an unavoidable consequence of adding a poor dielectric to a better one. This viewpoint can be seen, for example, in the third figure of British Pat. No. 791,205 where the dielectric strength of the claimed mixture is shown to be between that of its components, and it is stated at lines 62 through 77 of the patent that the dielectric strength of the mixture is higher than the expected mean of the two component gases.

With regard to the reported decrease in dielectric strength for gas mixtures, it should be noted that U.S. Pat. No. 3,506,774 does say in its abstract that mixtures of $SF_6$ and perfluorovinyl sulfur pentafluoride possess a dielectric strength greater than either component alone. But the abstract fails to account for the two factors critical to such a statement. These factors are of course the temperature and pressure at which the mixture and its two individual components were measured. Since dielectric strength varies with changes in temperature and/or pressure, the better dielectric strength of the mixture is only significant if measured at the same temperature and pressure as that of both component gases. In order to understand what is meant by the abstract's statement, it is necessary to study both the specifications and claims of this patent. No such statement is found in either Section. While some of the dielectric strength values reported in Table III of the specification are slightly higher than those of the best dielectric component in that mixture whose performance is reported in Table I, no conclusion can be drawn from a comparison of these figures because the temperature and pressure of the component gas were not accurately measured in the experiments. As reported at column 2, lines 16 through 18 of the specification, the experiments were carried out at substantially one atmosphere and at about room temperature. Since the gas liquifies at approximately room temperature and the tests were carried out at that temperature, the gas density was probably difficult to maintain and measure during the experiments. The performance data thus cannot be compared with that of the mixture since there could easily be small differences in temperature or pressure between this component and the mixture and these differences would certainly account for the mixture's slightly higher discharge values.

As can be seen from this discussion of the prior art, an undesirable feature of previously reported gas mixtures has been their decreased dielectric strength in comparison to that of the best dielectric in the mixture. It is therefore one object of the present invention to provide insulating media comprised of a mixture of two or more dielectric gases wherein the dielectric strength of the mixture is not reduced by the presence of a poorer dielectric and is in fact superior to that of any component gas at the same temperature and pressure. Another object of the invention is to provide insulating media of high dielectric strength and low boiling point. A further object of the invention is to provide a method for determining which range of proportions of said component gases yield a dielectric strength superior to that of any component gas at the same temperature and pressure.

Other objects, features and advantages of this invention will be obvious or will appear hereinafter.

SUMMARY OF THE INVENTION

Electrically insulating gaseous media comprised of mixtures of two or more dielectric gases have now been discovered wherein each such mixture possesses a dielectric strength superior to that of any dielectric gas in said mixture at the same temperature and pressure. In these mixtures, the dielectric strength of at least one of said dielectric gases increases at less than a linear rate with increasing pressure, and said gases are present in such proportions that the sum of their electrical discharge voltages at their respective partial pressures in said mixture exceeds the electrical discharge voltage of each said gas at the same temperature and pressure as that of said mixture.

Thus, when proper proportions of a poorer strength dielectric gas are added to a better one, there will be no reduction in the dielectric strength of the mixture which will instead exceed even that of the better dielectric gas in that mixture at the same temperature and pressure. As set forth above, two requirements must be fulfilled to produce such a mixture: (1) at least one of the component gases must have a dielectric strength which increases at less than a linear rate with increasing pressure and (2) the sum of the electrical discharge voltages for the component gases at their respective partial pressures in the mixture must exceed that of any one component gas at the same temperature and pressure as that of the mixture.

As explained more fully below, it appears that the reason why it is possible to produce mixtures of such superior dielectric strength is due to the discovery that the insulation strength of a mixture is generally equal to the sum of the dielectric strenghts of its component gases, rather than being equal to a value somewhere between the highest and lowest individual strengths as previously believed. Thus, high strength dielectric gases can be mixed with ones of poorer strength having other desirable properties such as lower cost without reducing dielectric strength. Since the boiling point of a mixture is determined by averaging methods rather than addition, a poorer dielectric gas having a low boiling point can be mixed with a high strength dielectric to produce a mixture having a boiling point lower than that of the latter gas, but with an even higher dielectric strength.

DETAILED DESCRIPTION OF THE INVENTION

As noted earlier, gas mixtures of unexpected high dielectric strength were formulated in accordance with this invention when it was discovered that a mixture's dielectric strength is a substantially additive function of the dielectric strengths of the component gases as their respective partial pressures. When this finding is considered in conjunction with other characteristics of such gases, it then becomes possible to formulate such mixtures for the electrically insulating gaseous media of this invention. One characteristic to be considered is the fact that the dielectric strength of a gas is fixed for a given temperature and pressure and for most gases increases at less than a linear rate. For example, two atmospheres of $SF_6$ will have less than twice the dielectric strength of one atmosphere of the gas. A second characteristic of such gases requiring consideration is the law of partial pressures which provides that the pressure of a gaseous mixture is equal to the sum of partial pressures of its component gases.

Since it has now been discovered that the dielectric strength of a mixture of two or more dielectric gases is generally additive, their individual strengths can be added together to provide a measure of the mixture's dielectric strength. At certain proportions of these component gases, the mixture strength will exceed that of even the best dielectric in the mixture. This is because the dielectric strength of at least one component gas at its partial pressure in the mixture will be greater than the strength of that component were it proportional to pressure. Thus, certain proportions of such a gas will contribute a sufficient amount of dielectric strength to boost the mixture strength beyond that of the best dielectric component at the same temperature and pressure.

Figure 1:
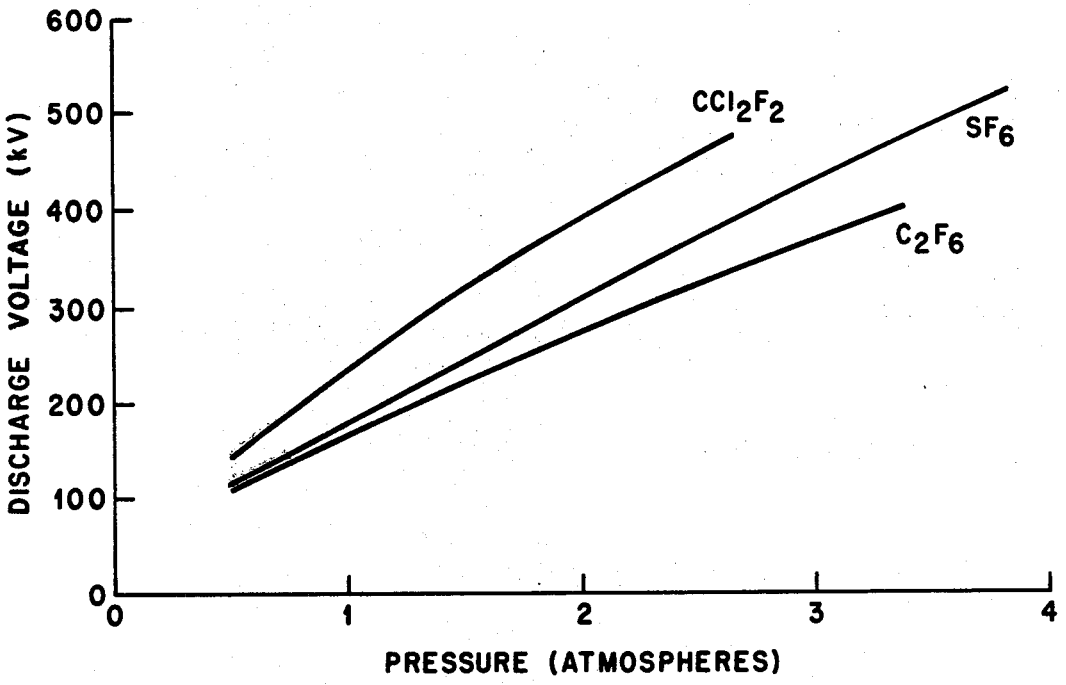
FIG. 1 is a graph showing the electrical discharge voltages for several dielectric gases over a range of pressures expressed in atmospheres.
Figure 2:
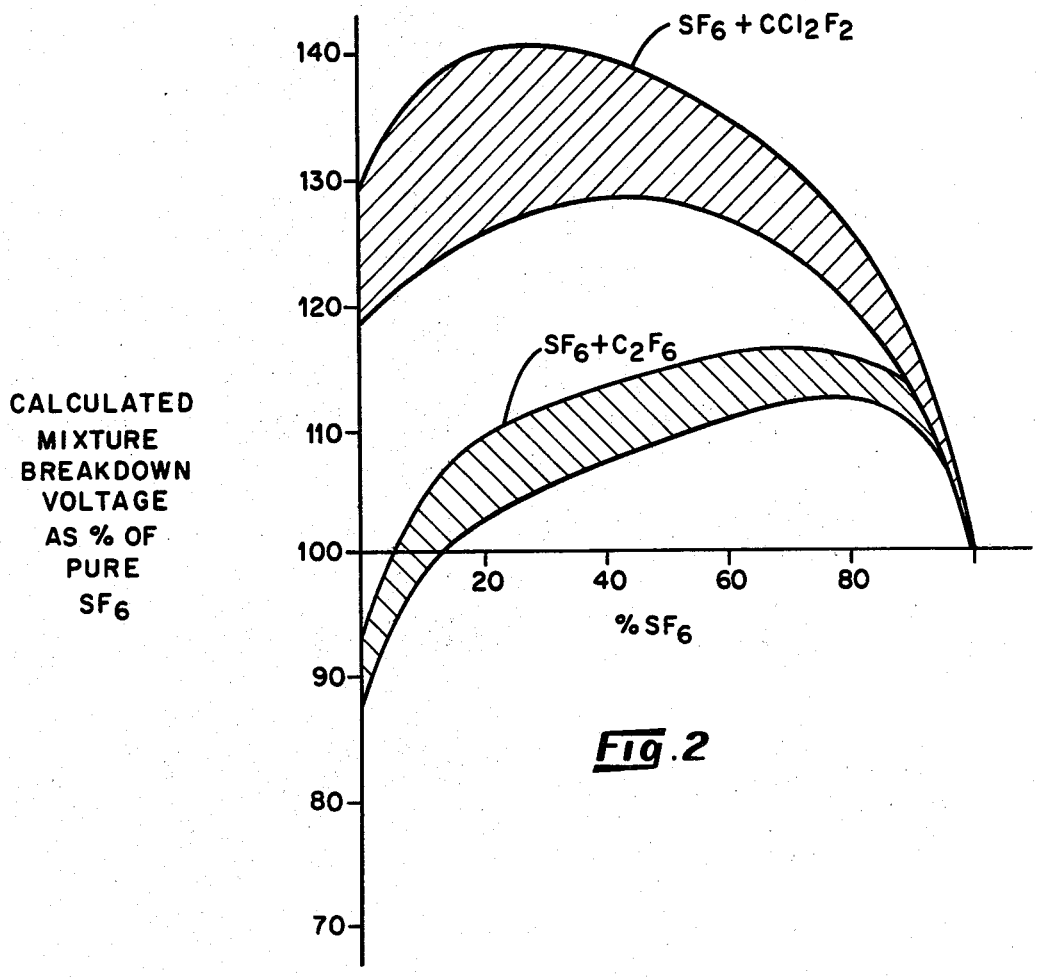
FIG. 2 is a graph showing the electrical discharge voltages calculated for mixtures of dielectric gases at fixed pressures from 2 to 4 atm. over a range of mixture proportions expressed as a percent of $SF_6$.
Figure 3:
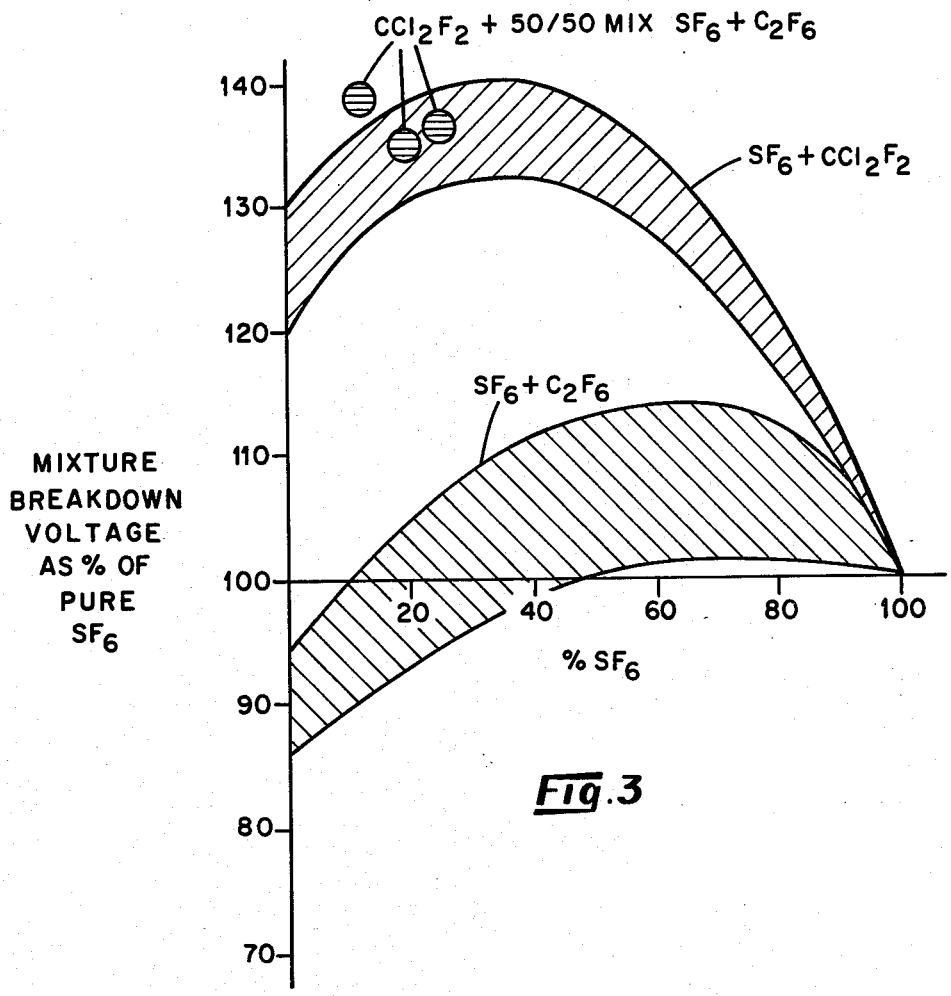
FIG. 3 is a graph showing the electrical discharge voltages for mixtures of dielectric gases as actually measured over a range of mixture proportions expressed as a percentage of $SF_6$ for total pressures from ½ to 3.7 atm.

This is illustrated by the graphs depicted in FIGS. 1, 2 and 3. The measurements set forth in the graphs of FIG. 1 and FIG. 3 were carried out on a coaxial electrode system comprised of two electrically conducting hollow cylinders: an outer conductor with an inner diameter of 10 inches encasing a center conductor with an outer diameter of 3 inches. To ensure the discharge would occur within the coaxial electrodes and not at the terminations a 1/16 inch diameter steel sphere was attached to the center conductor. The measurements were made with the electrodes placed inside a pressure vessel which was evacuated to less than 0.1 torr prior to each test run. The test gas or gases were then introduced to the desired pressure levels. In all but one instance, mixtures of gases were introduced from a separate tank rather than being mixed in the test system. Voltages in the range of 50 to 500 kV were applied to the center conductor and the current that crossed the gap between the center conductor and the outer conductor was measured with an electronic current meter.

For example, as shown in FIG. 1, pure $SF_6$ has a discharge voltage of 500 kV at 3.72 atm, while pure $C_2F_6$ has a discharge voltage of 435 kV at the same pressure. A 50:50 mixture by volume of these two gases at a pressure of 3.72 atm (1.86 atm $SF_6$ and 1.86 atm $C_2F_6$) was then determined by adding up the discharge voltages of the two gases at 1.86 atm. As shown in FIG. 2, the discharge voltage of $SF_6$ at 286 kV and of $C_2F_6$ at 256 kV added up to a calculated mixture strength of 542 kV. This agrees with the experimentally measured voltage of 550 kV for the gas mixture which is depicted in FIG. 3.

Of course, more than two gases can be added together to produce the dielectric gas mixtures of this invention. For example, as shown by the mixture performance of $SF_6$, $C_2F_6$ and $CCl_2F_2$ depicted as circles on the graph in FIG. 3, three or more gases may be added together to provide mixtures of unexpected dielectric strength. Moreover, since dielectric strength has now been found to be generally additive, it can be seen that increasing the number of component gases can further increase a mixture's dielectric strength, regardless of whether or not the additional gases are of higher or lower strength than the previous components.

While electronegative gases such as $SF_6$, $CCl_2F_2$, $C_2F_6$, $CF_3Cl$ and $CF_4$ are preferred since their good individual dielectric strength will provide an even greater composite strength, mixtures with electropositive gases such as $N_2$ and $CO_2$ which are normally poor dielectrics should also produce improved results in certain mixture proportions. Gases of very different dielectric strengths, however, tend to limit the range of mixture component proportions which will produce superior results. This is because the strength of the better gas cannot compensate for that of the much poorer gas when large percentages of the latter are employed.

To determine the proportions of dielectric gases which should produce mixtures of unexpectedly high dielectric strength, a three step method may be employed. It comprises the steps of measuring the electrical discharge voltage of each of the dielectric gases to be used in a mixture from the minimum to the maximum desirable partial pressure for each such gas; adding the electrical discharge voltages at the partial pressure of each said dielectric gas to determine the electrical discharge voltage of said gaseous mixture at each set of partial pressures; and comparing the electrical discharge voltage of the gaseous mixture with the electrical discharge voltages for each of said dielectric gases at the same temperature and pressure as that of said mixture. This calculated discharge voltage for the gas mixture will exceed that of any component gas for all gases whose dielectric strength is actually superior to that of any component dielectric gas at the same pressure and temperature.

It is possible that in some cases a mixture whose calculated electrical discharge voltage is superior to any component gas will possess a dielectric strength which is only as good as, or even somewhat less than, that of the mixtures best dielectric gas component. This may well be due to nonindependent behavior of the component gases whereby the full insulating strength of each gas could no longer be added together to determine actual mixture strength. It should be noted, however, that the essentially additive nature of mixture strength has held true in all experiments conducted thus far.

As can be seen from this description of the present invention, electrically insulating gaseous media comprised of two or more dielectric gases have now been found wherein the dielectric strength of the mixture exceeds that of even the best dielectric gas in the mixture at the same temperature and pressure. The examples which have been provided in the specification and in the accompanying figures are illustrative only, and should not be interpreted in a limiting sense.

What is claimed is:

1. An electrically insulating gaseous mixture consisting of sulfur hexafluoride and hexafluoroethane, said gases being present in such proportions that the sum of their electrical discharge voltages at their respective partial pressures in said mixture exceeds the electrical discharge voltage of each at the same temperature and pressure as that of said mixture.

* * * * *